US006420684B2

(12) United States Patent
Higgins

(10) Patent No.: US 6,420,684 B2
(45) Date of Patent: Jul. 16, 2002

(54) ASYMMETRIC RADIANT ELECTRIC HEATER WITH MULTIPLE HEATING ZONES

(75) Inventor: George Anthony Higgins, Hagley (GB)

(73) Assignee: Ceramaspeed Limited (GB)

( * ) Notice: Subject to any disclaimer, the term of this patent is extended or adjusted under 35 U.S.C. 154(b) by 0 days.

(21) Appl. No.: 09/822,560

(22) Filed: Mar. 30, 2001

(30) Foreign Application Priority Data

Apr. 3, 2000 (GB) ..... 0008031

(51) Int. Cl.[7] ..... H05B 3/68
(52) U.S. Cl. ..... 219/462.1
(58) Field of Search ..... 219/452.11, 460.1, 219/461.1, 462.1; 126/39 H, 90 A, 92 A, 211

(56) References Cited

U.S. PATENT DOCUMENTS

| | | | | | |
|---|---|---|---|---|---|
| 4,327,280 | A | * | 4/1982 | McWilliams | 219/448.19 |
| 4,347,432 | A | * | 8/1982 | Gossler | 219/448.19 |
| 5,498,854 | A | * | 3/1996 | McWilliams | 219/461.1 |
| D369,515 | S | * | 5/1996 | Higgins | 219/462.1 |
| 5,517,002 | A | * | 5/1996 | Higgins | 219/462.1 |
| 5,977,523 | A | * | 11/1999 | Scott | 219/447.1 |

FOREIGN PATENT DOCUMENTS

GB 2044057 10/1980

OTHER PUBLICATIONS

Search Report Aug. 30, 2000.

* cited by examiner

*Primary Examiner*—Sang Paik
(74) *Attorney, Agent, or Firm*—Ira S. Dorman

(57) ABSTRACT

An asymmetric radiant electric heater has multiple heating zones which can be arranged in a plurality of configurations. The heater comprises a dish-like support having two orthogonal axes of symmetry, a base of thermal and electrical insulation material in the dish-like support, a first heating element and a second heating element supported adjacent one another on a major surface of the base and forming an asymmetric arrangement in the dish-like support, a terminal block secured at a fixed location at an edge of the dish-like support, and a wall arrangement of thermal insulation material supported on the base and comprising a peripheral wall extending around the heater and a dividing wall, integral therewith, extending between the adjacent first and second heating elements to form at least two asymmetric heating zones. The wall arrangement is adapted and arranged to cooperate with the base and the terminal block whereby the wall arrangement is fitted to the heater in a first position to accommodate a first configuration of the adjacent first and second heating elements and in a second position, representing 180 degrees of rotation of the wall arrangement from the first position about an axis perpendicular to a base of the dish-like support, to accommodate a second configuration comprising a mirror image arrangement of the adjacent first and second heating elements.

28 Claims, 4 Drawing Sheets

ASYMMETRIC RADIANT ELECTRIC HEATER WITH MULTIPLE HEATING ZONES

This invention relates to an asymmetric radiant electric heater with multiple heating zones.

DESCRIPTION OF PRIOR ART

Asymmetric radiant electric heaters, for example oval heaters, with multiple heating zones are known, for example, from United Kingdom Patent Publication No. 2,044,057 in which an additional part-circular heated area is arranged to one side of the conventional circular heated area. In practice, the additional part-circular heated area can be arranged either to the left-hand side or to the right-hand side of the circular area. A significant disadvantage of such known oval heaters is that it is necessary to engineer, or tool, the left-hand and right-hand additional areas as separate products. It is also necessary to stock separate components for use in left- and right-handed heaters.

It would result in a significant saving in terms of investment and storage if the same components could be used for both left-and right-handed heaters.

OBJECT OF THE INVENTION

It is therefore an object of the present invention to provide an asymmetric radiant electric heater with multiple heating zones in which the same components can be used for multiple configurations.

SUMMARY OF THE INVENTION

According to the present invention there is provided an asymmetric radiant electric heater with multiple heating zones which can be arranged in a plurality of configurations, the heater comprising:

- a dish-like support having two orthogonal axes of symmetry;
- a base of thermal and electrical insulation material in the dish-like support;
- a first heating element and a second heating element supported adjacent one another on a major surface of the base and forming an asymmetric arrangement in the dish-like support;
- a terminal block secured at a fixed location at an edge of the dish-like support;
- a wall arrangement of thermal insulation material supported on the base and comprising a peripheral wall extending around the heater and a dividing wall, integral therewith, extending between the adjacent first and second heating elements to form at least two asymmetric heating zones;
- the wall arrangement being adapted and arranged to cooperate with the base and the terminal block whereby the wall arrangement is fitted to the heater in a first position to accommodate a first configuration of the adjacent first and second heating elements, and in a second position, representing 180 degrees of rotation of the wall arrangement from the first position about an axis perpendicular to a base of the dish-like support, to accommodate a second configuration comprising a mirror image arrangement of the adjacent first and second heating elements.

The dish-like support may be of substantially oval shape.

The first heating element may be of substantially circular configuration with the second heating element being of substantially part-circular configuration.

The dish-like support may have a long axis of symmetry and a short axis of symmetry and the terminal block may be secured at the edge of the dish-like support on the short axis of symmetry. The wall arrangement may have a long axis of symmetry corresponding to the long axis of symmetry of the dish-like support.

The base of thermal and electrical insulation material may be dished. The lower edge of the dividing wall may be profiled to correspond to the dish-shape of the base.

A recess may be provided in the peripheral wall at each end of the dividing wall at a lower edge of the wall arrangement to selectively accommodate electrical connections between the terminal block and one or more of the first and second heating elements.

A protrusion may be provided on the surface of the base of thermal and electrical insulation material directly opposite to where the electrical connections to the terminal block are provided and cooperating with an overlying one of the recesses at the end of the dividing wall to substantially fill such one of the recesses.

A pair of matching elongate projections may be provided directly opposite each other on opposite lower edges of an outer rim of the peripheral wall of the wall arrangement, one of the projections being arranged to bear on the terminal block, the other of the projections being accommodated in a substantially complementary recess provided in the base of thermal and electrical insulation material.

A rod-like temperature-responsive device may be provided at least partly crossing one of the heating zones.

The wall arrangement may comprise bound vermiculite.

The base may comprise microporous thermal and electrical insulation material.

The first heating element and the second heating element may comprise wire, ribbon, foil or film material. In particular, the first heating element and the second heating element may comprise corrugated ribbons supported edgewise on the base of thermal and electrical insulation material.

As a result of the present invention, a standard base component can be provided for a radiant heater, consisting of a dish-like support containing a base layer of insulation material and arranged to be fitted with a terminal block at a fixed symmetrical location. Asymmetric heating elements can be arranged on the base layer in a particular configuration, or a mirror image thereof. A single wall member is provided which, by simple orientation into a selected one of two positions, can be fitted to the base component to accommodate a particular arrangement of asymmetric heating elements, or a mirror image arrangement thereof.

For a better understanding of the present invention and to show more clearly how it may be carried into effect reference will now be made, by way of example, to the accompanying drawings in which:

DESCRIPTION OF PREFERRED EMBODIMENTS

Figure 1:
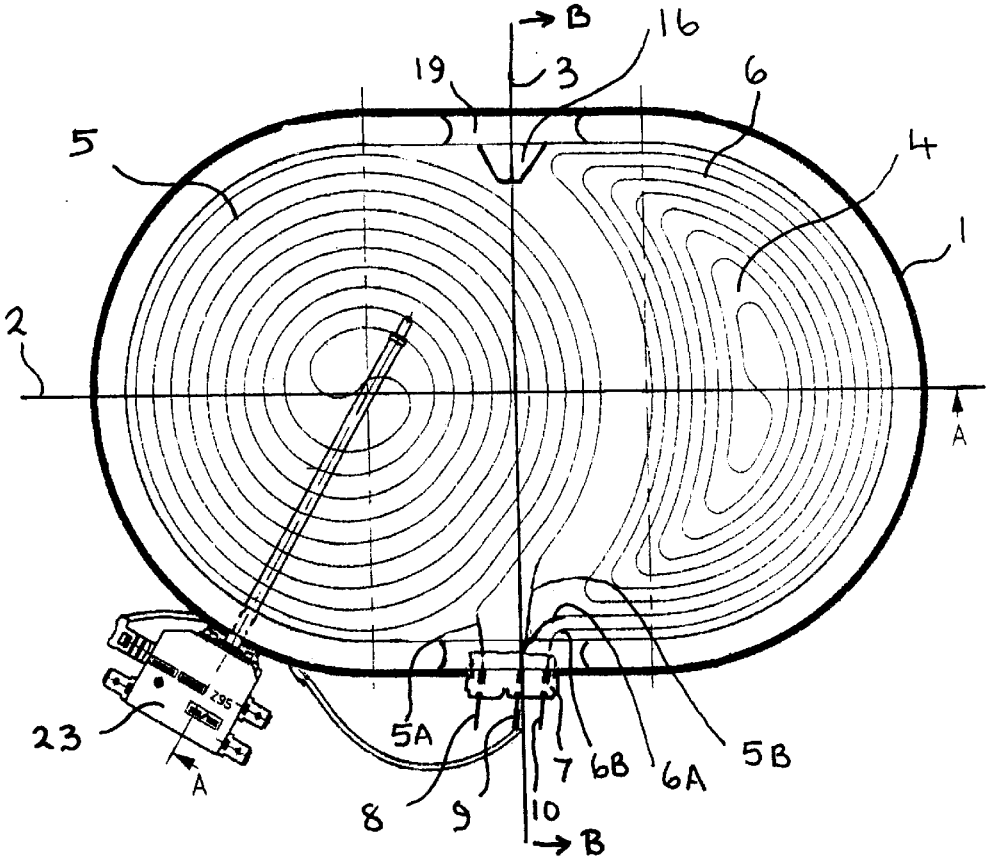
FIG. 1 is a top plan view of one embodiment of a base component of an asymmetric radiant electric heater according to the present invention in which a partcircular heating element is positioned to the right hand side of a circular heating element.
Figure 2:
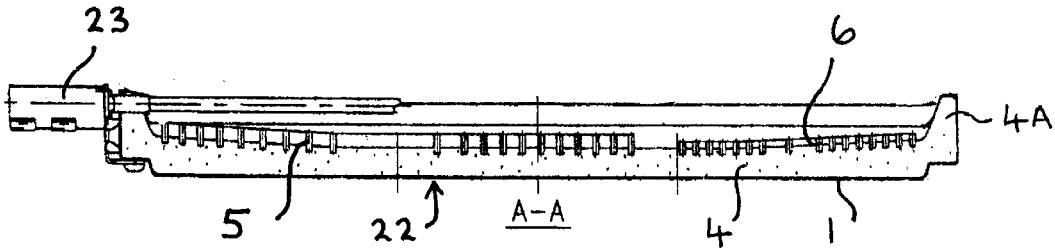
FIG. 2 is a cross-sectional view of the heater base component shown in FIG. 1 along the line A—A in FIG. 1.
Figure 3:
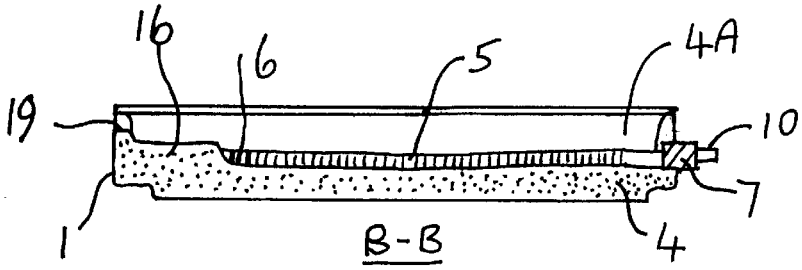
FIG. 3 is a cross-sectional view of the heater base component shown in FIG. 1 along the line B—B in FIG. 1.

Referring to FIGS. 1 and 2, an asymmetric radiant electric heater is constructed, starting with an oval metal dish-like support 1 having a long axis of symmetry 2 and a short axis of symmetry 3.

A base layer 4 of well-known microporous thermal and electrical insulation material is provided in the support 1 and has an upwardly-extending peripheral region 4A. The base layer 4 may be dished so as to provide a greater distance between the surface of the base layer and the plane in which the peripheral region 4A terminates in the central region of the base than in the peripheral region thereof At least one first heating element 5 is arranged in substantially circular configuration on the base layer 4 and at least one second heating element 6 is arranged in substantially part-circular configuration, adjacent the first heating element 5, on the base layer 4. The heating elements 5 and 6 can comprise any of the well known materials, such as wire, ribbon, foil or film materials. In particular, the heating elements 5 and 6 may be of corrugated ribbon form and may be supported edgewise, in well known manner, on the base layer 4.

A terminal block 7 is arranged at a fixed location at an edge of the dish-like support 1. The terminal block 7 is secured at the edge of the dish-like support 1 on the short axis of symmetry 3.

Heating element 5 has end portions 5A and 5B electrically connected to terminals 8 and 9 respectively of the terminal block 7 and heating element 6 has end portions 6A and 6B electrically connected to terminals 9 and 10 respectively of the terminal block 7. Thus, terminal 9 is common to both heating elements 5 and 6.

The terminals 8, 9, 10 of the terminal block 7 may be connected to a voltage supply (not shown) such that heating element 5 is energisable alone, or together with heating element 6. Terminal 9 of the terminal block 7 is connected to the voltage supply by way of a well-known form of rod-like temperature-responsive device 23 which extends from the edge of the dish-like support 1 partly across the heating element 5.

Figure 4:
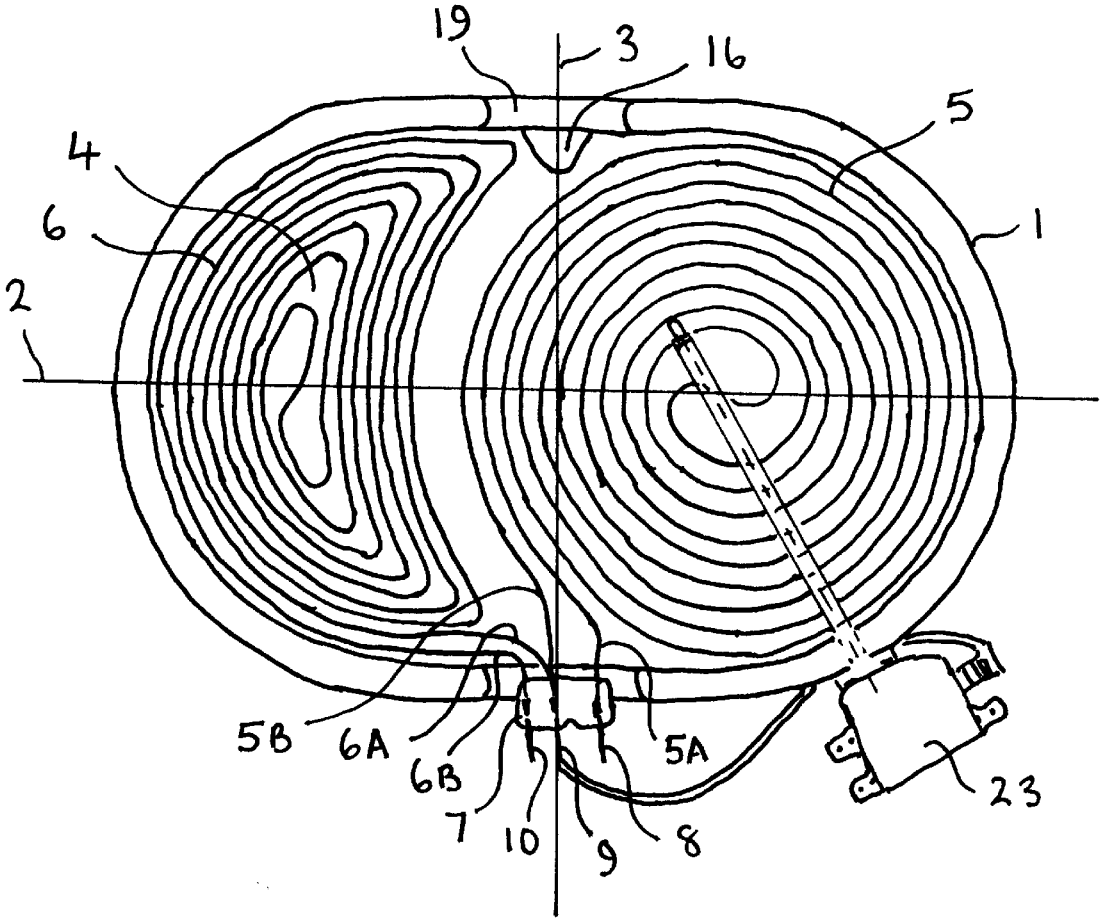
FIG. 4 is a top plan view of another embodiment of a base component of an asymmetric radiant electric heater according to the present invention in which a partcircular heating element is positioned to the left hand side of a circular heating element.

As shown in FIG. 4, a base component for a heater may be constructed up to the same stage as that of FIG. 1 with the exception that, whereas the arrangement of FIG. 1 has the substantially part-circular heating element 6 situated at the right hand side of the circular heating element 5, the arrangement of FIG. 4 has the substantially part-circular heating element 6 situated at the left hand side of the circular heating element 5.

Both forms of heater base component are constructed using a common form of dish-like support 1, with base layer 4, only the configuration of the heating elements being different, as required for different user applications, such as in glass-ceramic cooking appliances.

Figure 5:
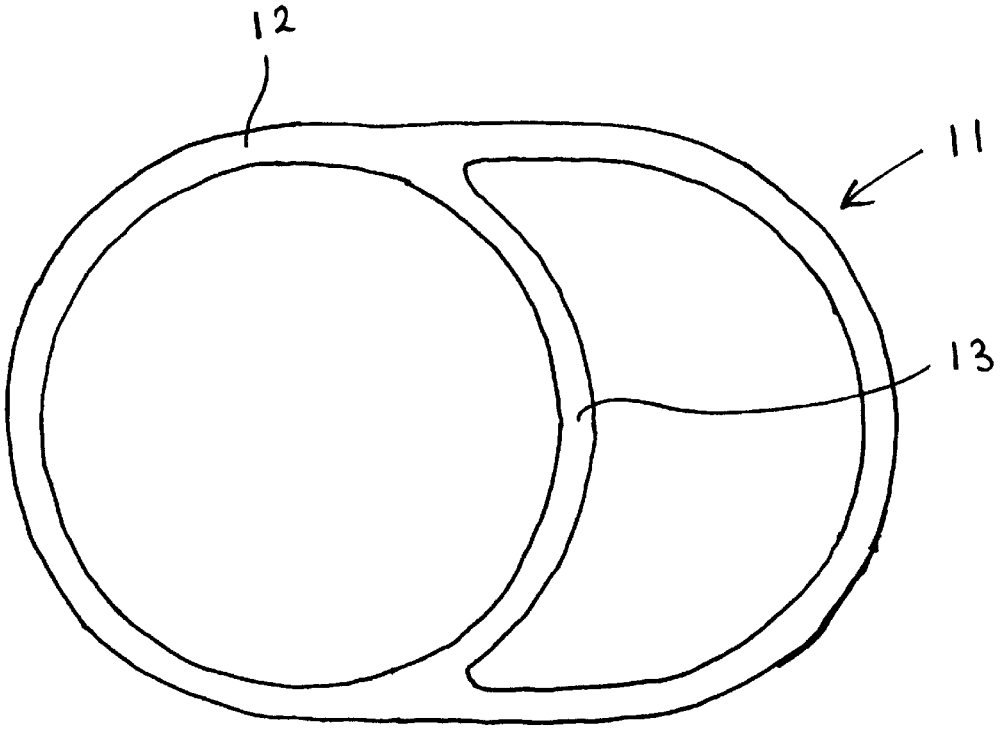
FIG. 5 is a top plan view of a wall arrangement for use with the base components shown in FIGS. 1 and 4.
Figure 6:
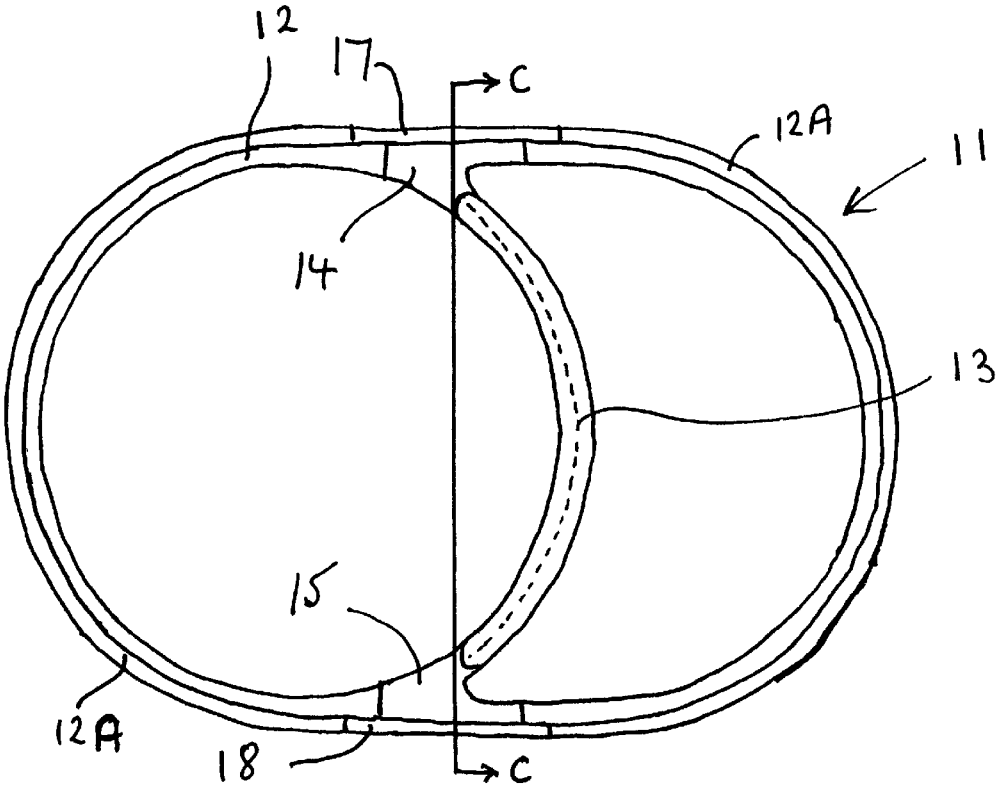
FIG. 6 is a bottom plan view of the wall arrangement shown in FIG. 5.
Figure 7:
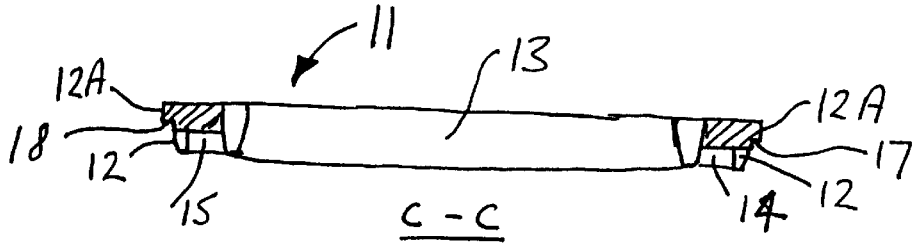
FIG. 7 is a cross-sectional view of the wall arrangement shown in FIG. 6 along the line C—C shown in FIG. 6.

A wall arrangement 11 of thermal insulation material, as shown in FIGS. 5, 6 and 7, is provided for adding to the base components of FIGS. 1 and 4 to produce finished heaters. The wall arrangement 11 is constructed of bound vermiculite, suitably comprising exfoliated articles of vermiculite bound with potassium silicate. the wall arrangement 11 is symmetrical about the long axis.

The wall arrangement 11 is arranged for supporting on the base 4 of insulation material of the base component of the heater and comprises a peripheral wall 12 for extending around the heater, and an integral dividing wall 13 for extending between the first and second heating elements 5 and 6. Because the base 4 is dished, the dividing wall 13 extends downwardly in the central region by a greater distance than in the end regions thereof, by about 3 mm. The wall arrangement is stepped so that an outer rim 12A of the peripheral wall is supported by the upper surface of the upwardly-extending peripheral region 4A.

Recesses 14 and 15 are provided in the peripheral wall 12 and the dividing wall 13 in the region of the ends of the dividing wall 13, at a lower edge of the wall arrangement 11. When the wall arrangement is fitted to the base component of the heater of FIG. 1, the recess 14 at the end of the dividing wall 13 allows the end portions SA, 5B of the first heating element 5 and the end portions 6A. 6B of the second heating element 6 to pass under the wall for connection to the terminal block. In this orientation of the wall arrangement 11, the corresponding recess 15 at the other end of the dividing wall 13 overlies, and is substantially filled by, a protrusion 16 provided on the surface of the base layer 4 of insulation material directly opposite to where the electrical connections to the terminal block 7 are provided. The protrusion 16 is suitably formed integrally with the base layer 4.

A pair of matching elongate projections 17 and 18 are provided directly opposite each other on opposite lower edges of the outer rim 12A of the peripheral wall 12 of the wall arrangement 11 (FIG. 7). The projection 17 is arranged to bear upon the terminal block 7 of the base component of FIG. 1 while the projection 18 is accommodated in a substantially complementary elongate recess 19 provided in the upwardly-extending peripheral region 4A at the edge of the base layer 4 of insulation material.

Figure 8:
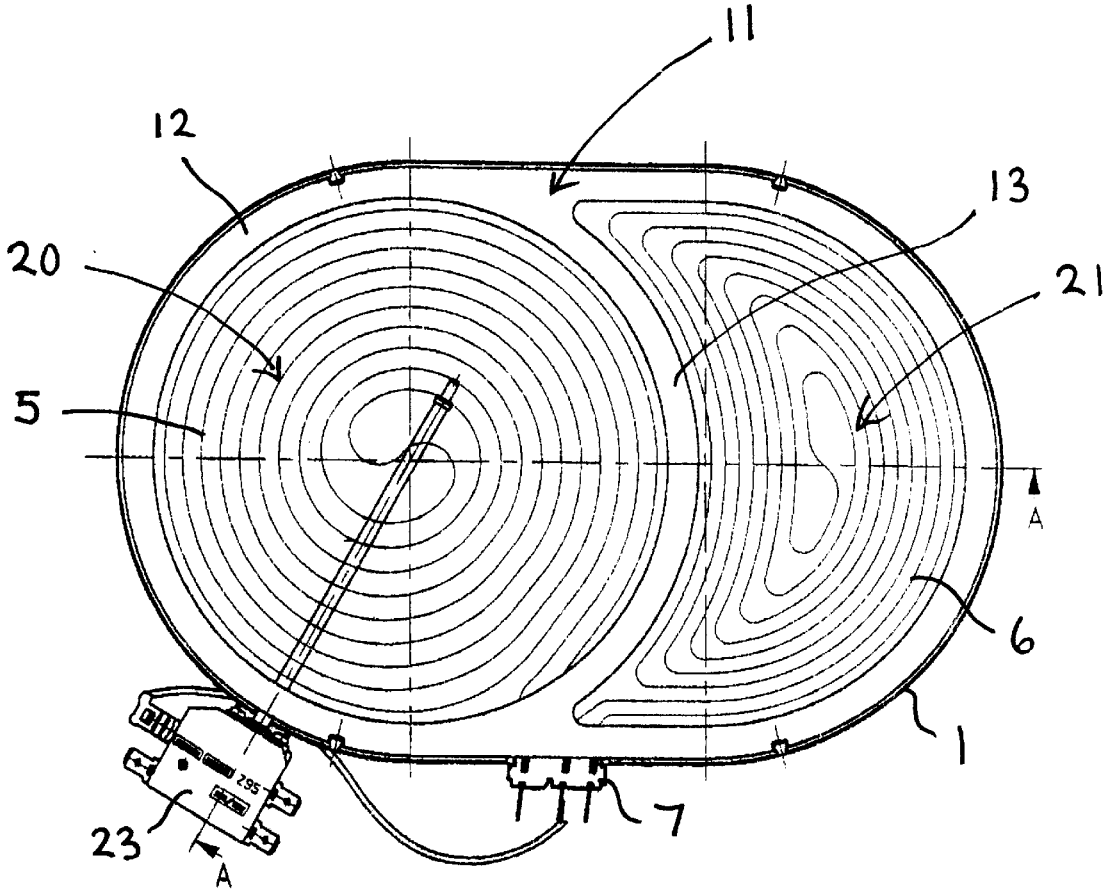
FIG. 8 is a top plan view of an embodiment of an asymmetric radiant electric heater according to the present invention in which the wall arrangement shown in FIGS. 5 and 6 is fitted to the base component shown in FIG. 1.

FIG. 8 shows a finished heater in which the wall arrangement 11 of FIGS. 5 to 7 is fitted to the base component of FIG. 1 and first and second heating zones 20 and 21 are formed in the heater.

The wall arrangement 11 of FIGS. 5 to 7 also fits, without modification, the heater base component of FIG. 4. The heating elements 5 and 6 of FIG. 4 comprise a mirror image arrangement of the heating element 5 and 6 of FIG. 1. The wall arrangement 11 is fitted to the base component of FIG. 4 in an orientation which represents 180 degrees of rotation of the wall arrangement about an axis perpendicular to a base 22 (FIG. 2) of the dish-like support 1, compared with the orientation when fitted to the base component of FIG. 1 (that is, mirrored about a vertical plane through the short axis of the oval heater). When the wall arrangement is fitted to the base component of FIG. 4, the recess 15 at the end of the dividing wall 13 accommodates the end portions 5A, 5B of the first heating element 5 and the end portions 6A, 6B of the second heating element 6, while the corresponding recess 14 at the other end of the dividing wall 13 overlies, and is substantially filled by, protrusion 16 provided on the surface of the base layer 4 of insulation material.

Elongate projection 18 on the lower edge of the outer rim 12A of the peripheral wall 12 of the wall arrangement 11 bears on the terminal block 7, while the corresponding projection 17 at the opposite side of the outer rim of the peripheral wall 12 is accommodated in recess 19 provided at the edge of the base layer 4 of insulation material.

I claim:

1. An asymmetric radiant electric heater with multiple heating zones which can be arranged in a plurality of configurations, the heater comprising:

a dish-like support having two orthogonal axes of symmetry;

a base of thermal and electrical insulation material in the dish-like support;

a first heating element and a second heating element supported adjacent one another on a major surface of the base and forming an asymmetric arrangement in the dish-like support;

a terminal block secured at a fixed location at an edge of the dish-like support;

a wall arrangement of thermal insulation material supported on the base and comprising a peripheral wall extending around the heater and a dividing wall, integral therewith, extending between the adjacent first and second heating elements to form at least two asymmetric heating zones, the peripheral wall being provided with a recess at each end of the dividing wall at a lower edge of the wall arrangement to selectively accommodate electrical connections between the terminal block and at least one of the first and second heating elements;

the wall arrangement being adapted and arranged to cooperate with the base and the terminal block whereby the wall arrangement is fitted to the heater in a first position to accommodate a first configuration of the adjacent first and second heating elements and in a second position, representing 180 degrees of rotation of the wall arrangement from the first position about an axis perpendicular to a base of the dish-like support, to accommodate a second configuration comprising a mirror image arrangement of the adjacent first and second heating elements.

2. A heater according to claim 1, wherein the dish-like support is of substantially oval shape.

3. A heater according to claim 2, wherein the first heating element is of substantially circular configuration and the second heating element is of substantially part-circular configuration.

4. A heater according to claim 2, wherein the dish-like support has a long axis of symmetry and a short axis of symmetry.

5. A heater according to claim 4, wherein the terminal block is secured at the edge of the dish-like support on the short axis of symmetry.

6. A heater according to claim 4, wherein the wall arrangement has a long axis of symmetry corresponding to the long axis of symmetry of the dish-like support.

7. A heater according to claim 1, wherein the base of thermal and electrical insulation material is dished.

8. A heater according to claim 7, wherein a lower edge of the dividing wall is profiled to correspond to the dish-shape of the base.

9. A heater according to claim 1, wherein a protrusion is provided on the surface of the base of thermal and electrical insulation material directly opposite to where the electrical connections to the terminal block are provided and cooperating with an overlying one of the recesses at the end of the dividing wall to substantially fill such one of the recesses.

10. A heater according to claim 1, wherein a pair of matching elongate projections are provided directly opposite each other on opposite lower edges of an outer rim of the peripheral wall of the wall arrangement, one of the projections being arranged to bear on the terminal block, the other of the projections being accommodated in a substantially complementary recess provided in the base layer of thermal and electrical insulation material.

11. A heater according to claim 1, wherein a rod-like temperature-responsive device is provided at least partly crossing one of the heating zones.

12. A heater according to claim 1, wherein the wall arrangement comprises bound vermiculite.

13. A heater according to claim 1, wherein the base comprises microporous thermal and electrical insulation material.

14. A heater according to claim 1, wherein the first heating element and the second heating element are selected from wire, ribbon, foil and film material.

15. A heater according to claim 14, wherein the first heating element and the second heating element comprise corrugated ribbons supported edgewise on the base of thermal and electrical insulation material.

16. An asymmetric radiant electric heater with multiple heating zones which can be arranged in a plurality of configurations, the heater comprising:

a dish-like support having two orthogonal axes of symmetry;

a base of thermal and electrical insulation material in the dish-like support;

a first heating element and a second heating element supported adjacent one another on a major surface of the base and forming an asymmetric arrangement in the dish-like support;

a terminal block secured at a fixed location at an edge of the dish-like support;

a wall arrangement of thermal insulation material supported on the base and comprising a peripheral wall extending around the heater and a dividing wall, integral therewith, extending between the adjacent first and second heating elements to form at least two asymmetric heating zones, a pair of matching elongate projections being provided directly opposite each other on opposite lower edges of an outer rim of the peripheral wall of the wall arrangement, one of the projections being arranged to bear on the terminal block and the other of the projections being accommodated in a substantially complementary recess provided in the base layer of thermal and electrical insulation material;

the wall arrangement being adapted and arranged to cooperate with the base and the terminal block whereby the wall arrangement is fitted to the heater in a first position to accommodate a first configuration of the adjacent first and second heating elements and in a second position, representing 180 degrees of rotation of the wall arrangement from the first position about an axis perpendicular to a base of the dish-like support, to accommodate a second configuration comprising a mirror image arrangement of the adjacent first and second heating elements.

17. A heater according to claim 16, wherein the dish-like support is of substantially oval shape.

18. A heater according to claim 17, wherein the first heating element is of substantially circular configuration and the second heating element is of substantially partcircular configuration.

19. A heater according to claim 17, wherein the dish-like support has a long axis of symmetry and a short axis of symmetry.

20. A heater according to claim 19, wherein the terminal block is secured at the edge of the dish-like support on the short axis of symmetry.

21. A heater according to claim 19, wherein the wall arrangement has a long axis of symmetry corresponding to the long axis of symmetry of the dish-like support.

22. A heater according to claim 16, wherein the base of thermal and electrical insulation material is dished.

23. A heater according to claim 22, wherein a lower edge of the dividing wall is profiled to correspond to the dish-shape of the base.

24. A heater according to claim 16, wherein a rod-like temperature-responsive device is provided at least partly crossing one of the heating zones.

25. A heater according to claim 16, wherein the wall arrangement comprises bound vermiculite.

26. A heater according to claim 16, wherein the base comprises microporous thermal and electrical insulation material.

27. A heater according to claim 16, wherein the first heating element and the second heating element are selected from wire, ribbon, foil and film material.

28. A heater according to claim 27, wherein the first heating element and the second heating element comprise corrugated ribbons supported edgewise on the base of thermal and electrical insulation material.

* * * * *